US010724827B2

(12) United States Patent
Brock

(10) Patent No.: US 10,724,827 B2
(45) Date of Patent: Jul. 28, 2020

(54) SHOOTING ADAPTER FOR FIREARM CARRY SLING

(71) Applicant: John David Brock, St. Johns, FL (US)

(72) Inventor: John David Brock, St. Johns, FL (US)

( * ) Notice: Subject to any disclaimer, the term of this patent is extended or adjusted under 35 U.S.C. 154(b) by 0 days.

(21) Appl. No.: 16/523,276

(22) Filed: Jul. 26, 2019

(65) Prior Publication Data

US 2020/0041227 A1 Feb. 6, 2020

Related U.S. Application Data

(60) Provisional application No. 62/713,011, filed on Aug. 1, 2018.

(51) Int. Cl.
*F41C 33/00* (2006.01)

(52) U.S. Cl.
CPC ..... *F41C 33/001* (2013.01); *F41C 33/002* (2013.01)

(58) Field of Classification Search
CPC .... F41C 33/001; F41C 33/002; F41C 33/007; A45F 2005/006; A45F 3/14
USPC ..... 224/150
See application file for complete search history.

(56) References Cited

U.S. PATENT DOCUMENTS

| | | | | |
|---|---|---|---|---|
| 7,841,496 | B1 * | 11/2010 | Schweikert | F41C 33/002 224/150 |
| 9,528,795 | B1 * | 12/2016 | Burnsed, Jr. | F41C 33/002 |
| 9,587,908 | B2 * | 3/2017 | Bjelde | F41C 33/007 |
| 9,835,407 | B2 * | 12/2017 | McLean | F41C 23/02 |
| 2010/0206921 | A1 * | 8/2010 | Shen | F41C 33/002 224/150 |
| 2020/0041227 | A1 * | 2/2020 | Brock | F41C 33/001 |
| 2020/0149842 | A1 * | 5/2020 | Marshall | F41C 33/002 |

* cited by examiner

*Primary Examiner* — Justin M Larson
(74) *Attorney, Agent, or Firm* — Bennet K. Langlotz; Langlotz Patent & Trademark Works, LLC

(57) ABSTRACT

A rifle sling is provided for use with a shooting adapter for a firearm. The rifle sling comprises a first portion having a forward end including a first attachment facility configured for attachment to a forward portion of a rifle, and a second portion having a rear end including a second attachment facility configured for attachment to a rear portion of a rifle. Further, a connector is configured to removable connect the first and second portion, the connector includes three parallel bars collectively defining two elongated slots. One of the slots has a lateral opening at a slots end, the opening is configured to removably retain a strap and to permit removal and insertion of an intermediate portion of the strap.

1 Claim, 7 Drawing Sheets

SHOOTING ADAPTER FOR FIREARM CARRY SLING

CROSS-REFERENCE TO RELATED APPLICATIONS

This application claims the benefit of U.S. Provisional Patent Application No. 62/713,011 filed on Aug. 1, 2018, entitled "Shooting Adapter for Firearm Carry Sling", which is hereby incorporated by reference in its entirety for all that is taught and disclosed therein.

FIELD OF THE INVENTION

The present invention relates to a rifle sling, and more particularly, to a rifle sling in conjunction with a shooting adapter for a firearm.

BACKGROUND OF THE INVENTION

Carry slings have been used as shooting aids going back at least as far as the turn of the 20th century. Wrapping the support (non-firing) arm with the carry sling aids in steadying the muzzle and reducing shooter fatigue for greater accuracy. The most effective methods involve placing a loop attached to the carry sling high under the shooter's arm. Unfortunately, due to the small size of most loops, installing and uninstalling the carry sling from the shooter's arm is slow and difficult. The length of time necessary for installation prevents its use in some hunting and sporting scenarios. Further, in life-threatening scenarios, the support arm being tightly squeezed into the carry sling can be hazardous for the user if the firearm needs to be discarded or slung quickly.

During competitions in England in the early 20th century, competitive rifle shooters would remove their carry sling attachment from the rear of the rifle and attach it to the middle of the firearm. The result was a large loop connected to the firearm's front and mid sections that allowed for more accurate shooting. Additionally, due to the size of the loop, the competitor could quickly install it on their arm for shooting and remove it in an instant. Once firing was completed, the aft sling attachment would be returned to the rear of the rife for convenient carry.

The limitations of the prior art are addressed by providing a rifle sling for use with a shooting adapter for a firearm. The rifle sling comprises a first portion having a forward end including a first attachment facility configured for attachment to a forward portion of a rifle, and a second portion having a rear end including a second attachment facility configured for attachment to a rear portion of a rifle. Further, a connector is configured to removable connect the first and second portion, the connector includes three parallel bars collectively defining two elongated slots. One of the slots has a lateral opening at a slots end, the opening is configured to removably retain a strap and to permit removal and insertion of an intermediate portion of the strap.

SUMMARY OF THE INVENTION

When used in conjunction with a carry sling, the shooting adapter is attached to the midpoint of the firearm and carry sling. The carry sling remains attached to the firearm's fore and aft locations. It creates a large loop for the shooter to utilize to steady their shot(s) while allowing for instantaneous removal once shooting has ended.

Many modern carry slings are designed for the firearm to be carried across the user's body rather than simply over the shoulder. The shooting adapter allows the user to continue to wear the firearm slung across their body while having the ability to use the loop created by the shooting adapter for maximum accuracy. The user can install the loop created by the shooting adapter in a minimal time frame. Removal is even faster, requiring only lifting the support elbow and pulling the hand out of the loop.

Due to the modular design of the shooting adapter, it can also be utilized as a shooting aid without a carry sling when attached to the front of a firearm. When wrapped around a fixed object, such as a fence post or tree limb, the shooting adapter can stabilize the muzzle for maximum accuracy.

DETAILED DESCRIPTION OF A PREFERRED EMBODIMENT

Figure 1:
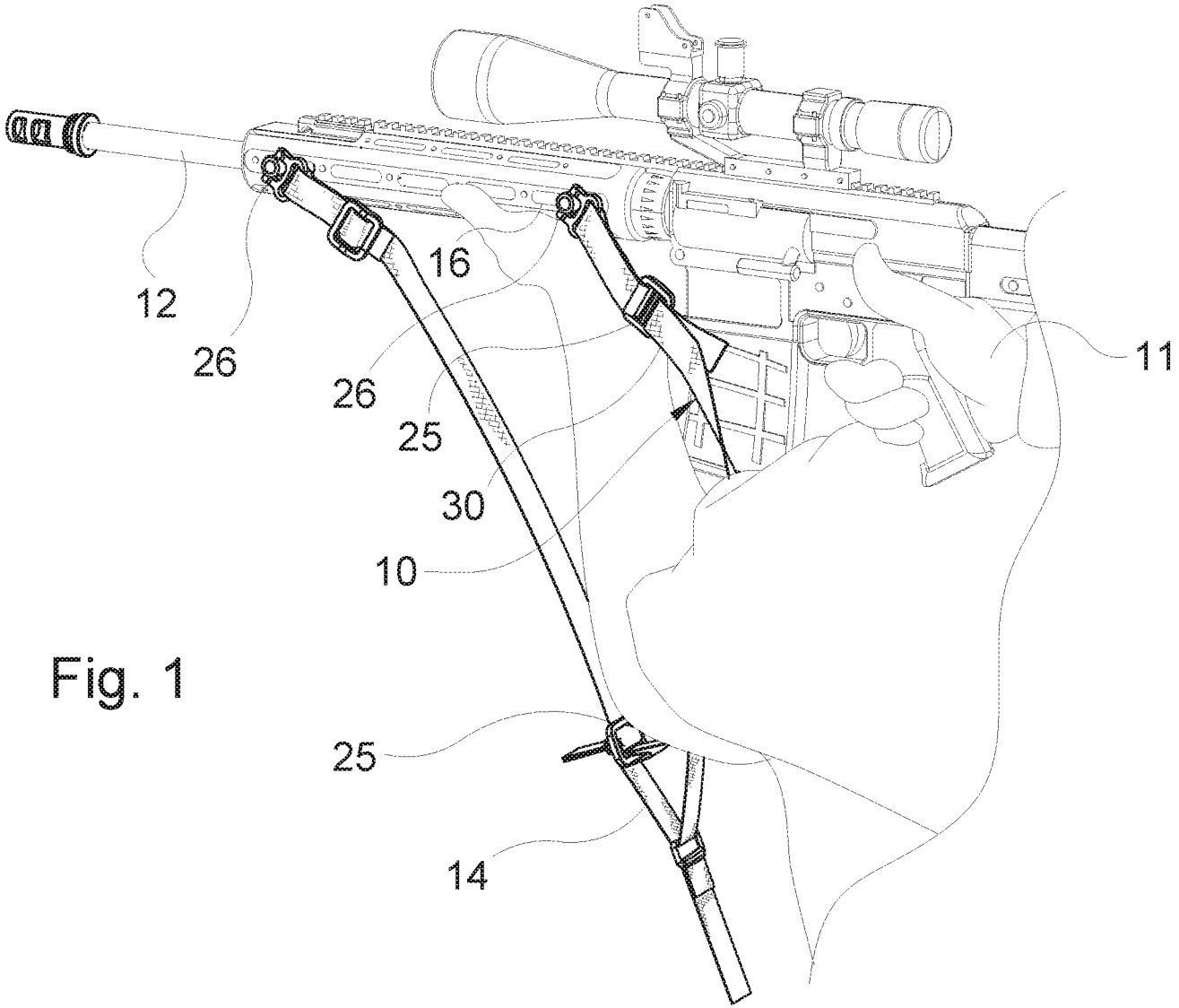
FIGS. 1-7 show various views of a preferred embodiment of the invention.

FIG. 1 shows the shooting adapter in use and wrapped around the shooter's support arm. It is attached to the mid-point of the firearm at one end and the carry sling at the other.

Figure 2:
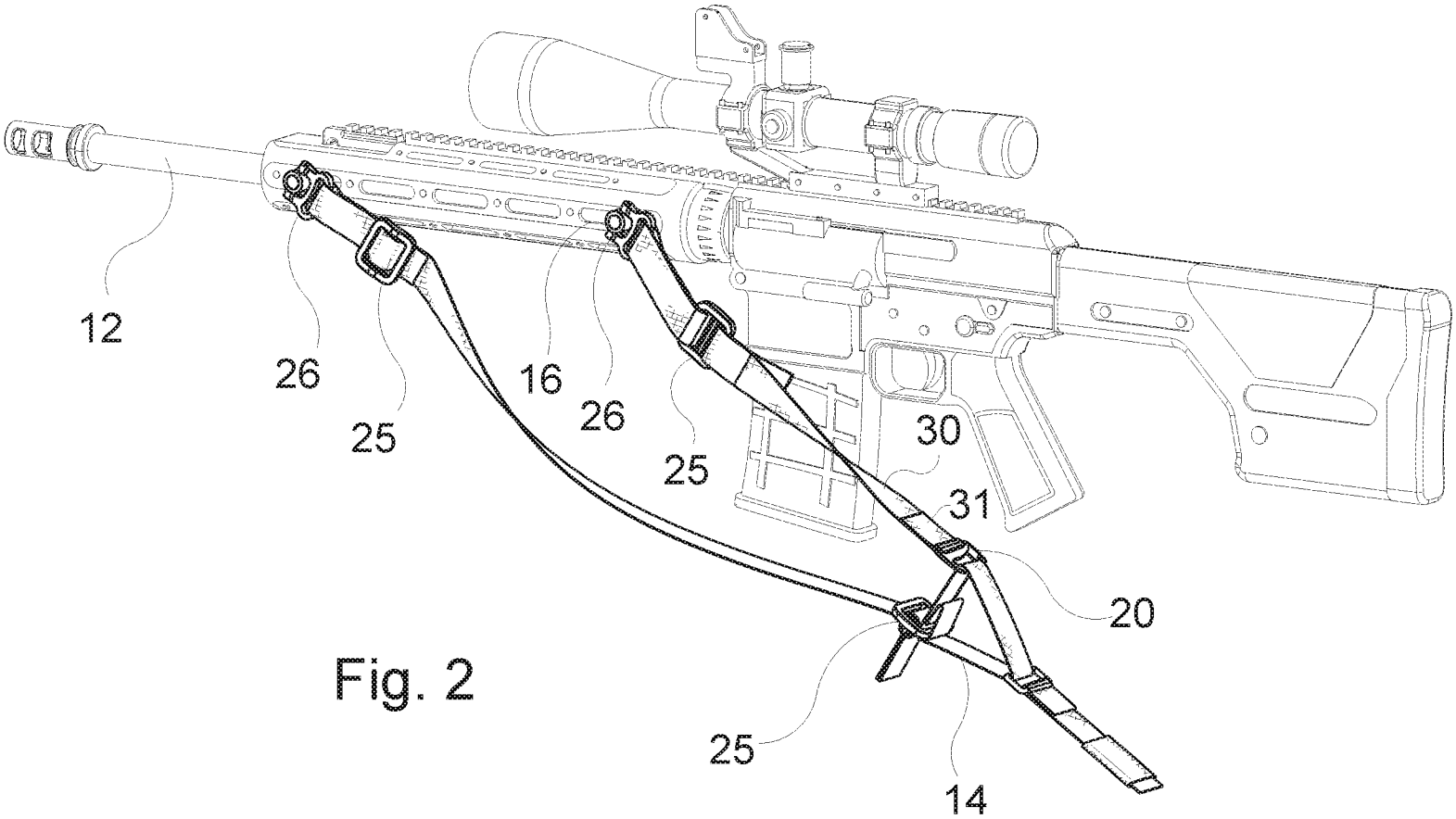

FIG. 2 shows the shooting adapter attached to the firearm and carry sling while not in use.

Figure 3:
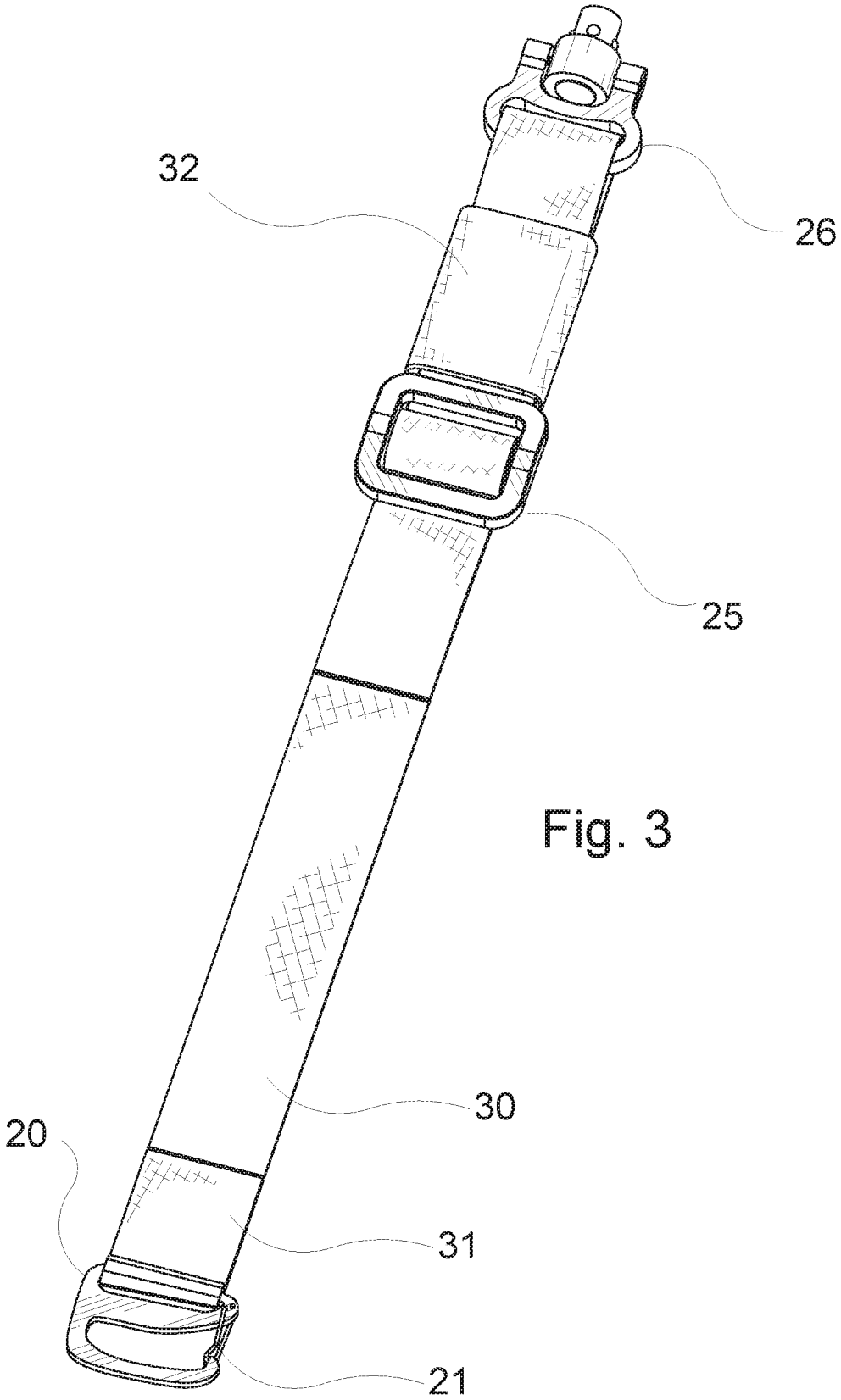

FIG. 3 shows the complete shooting adapter assembly. The proprietary hook is permanently attached to one end and a quick-detachable swivel is attached to the adjustable end.

Figure 4:
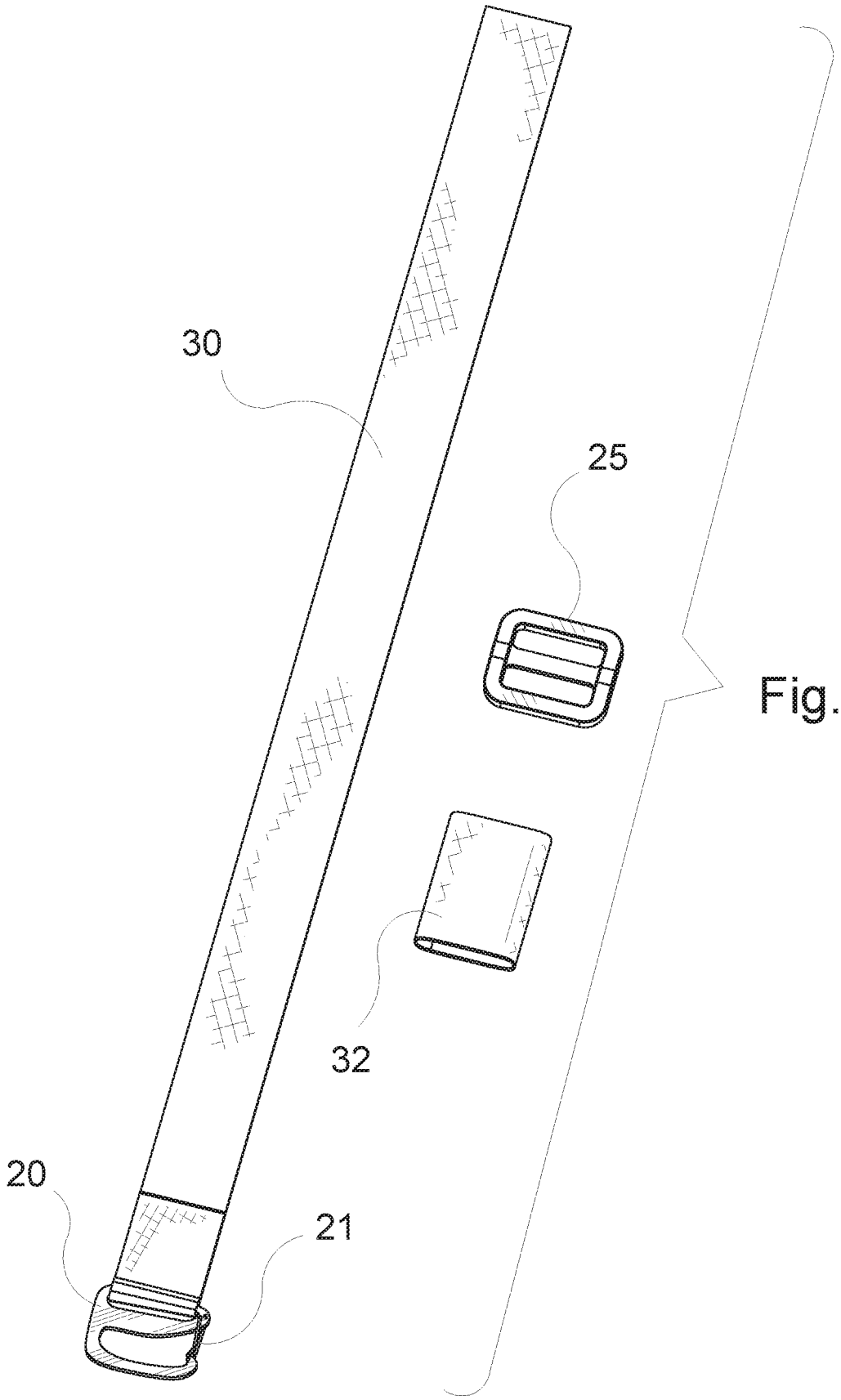

FIG. 4 shows the shooting adapter disassembled into its pieces. The shooting adapter is made up of a length of nylon webbing with a proprietary hook sewn into one end. A tri-glide is used to maintain the loose and provide for length adjustability. Also shown is an elastic keeper that holds the folded shooting adapter together for storage.

Figure 5:
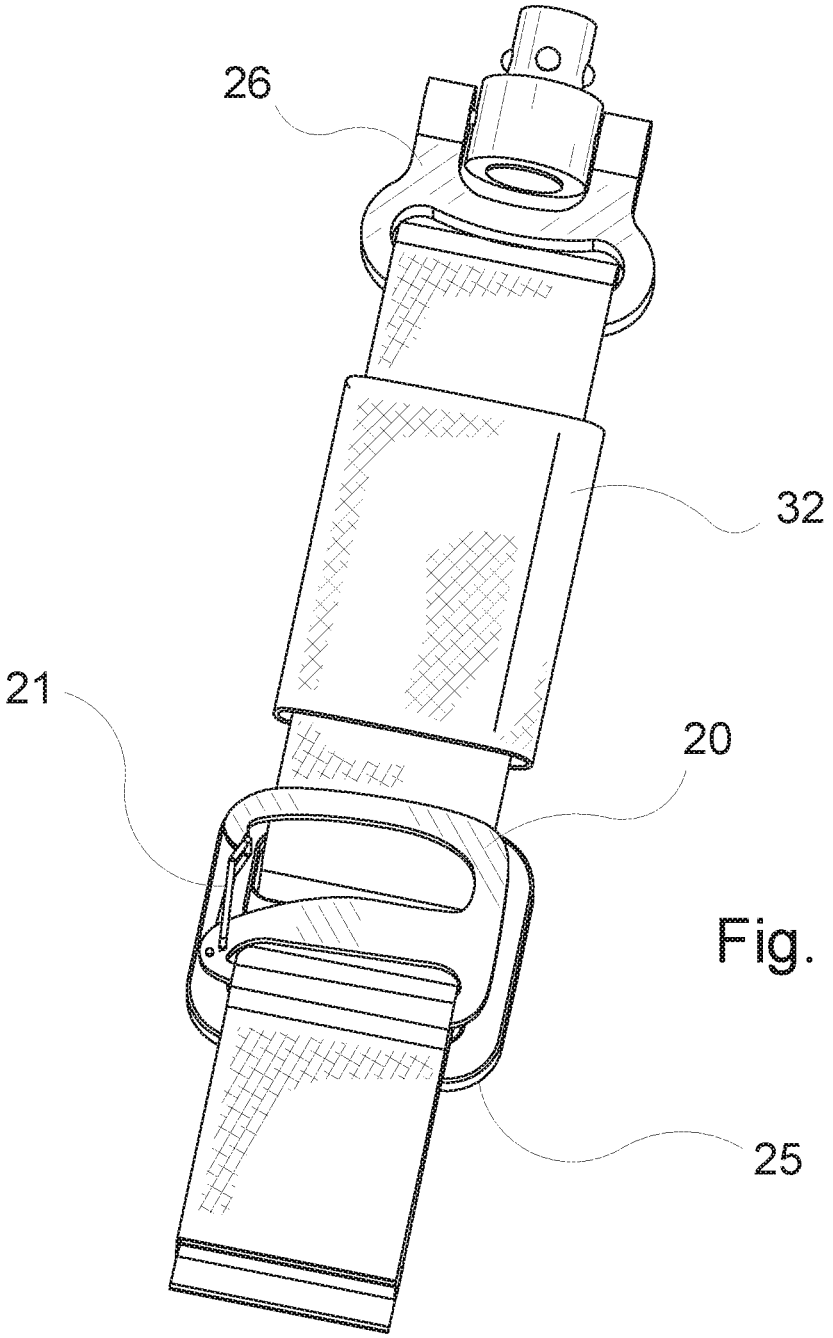

FIG. 5 shows the shooting adapter folded for storage with a quick-detach swivel attached.

Figure 6A:
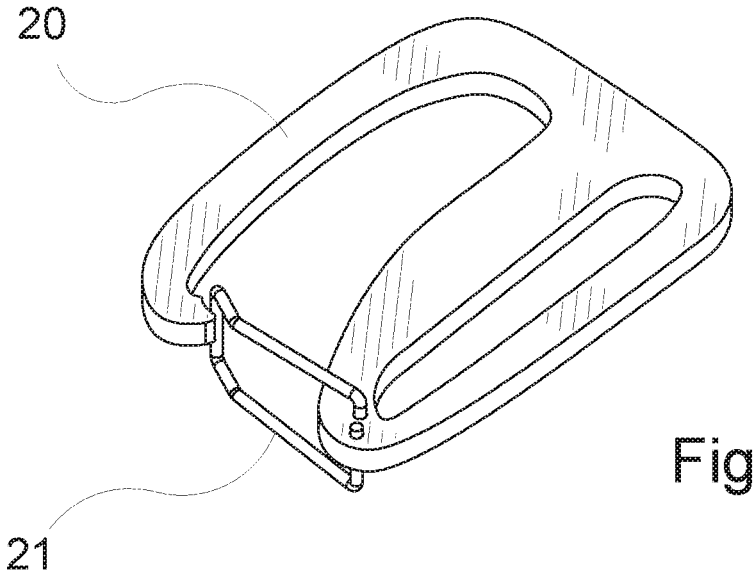
Figure 6B:
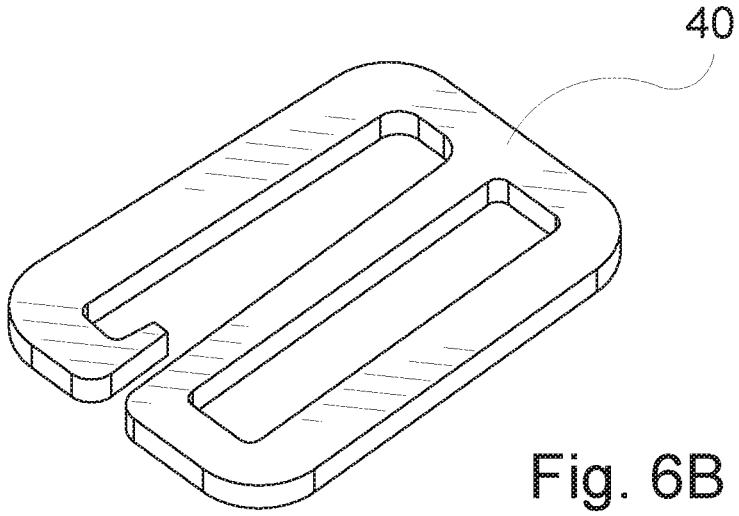

FIG. 6 shows an unattached proprietary hook that is used to attach the shooting adapter to a carry sling.

Figure 7:
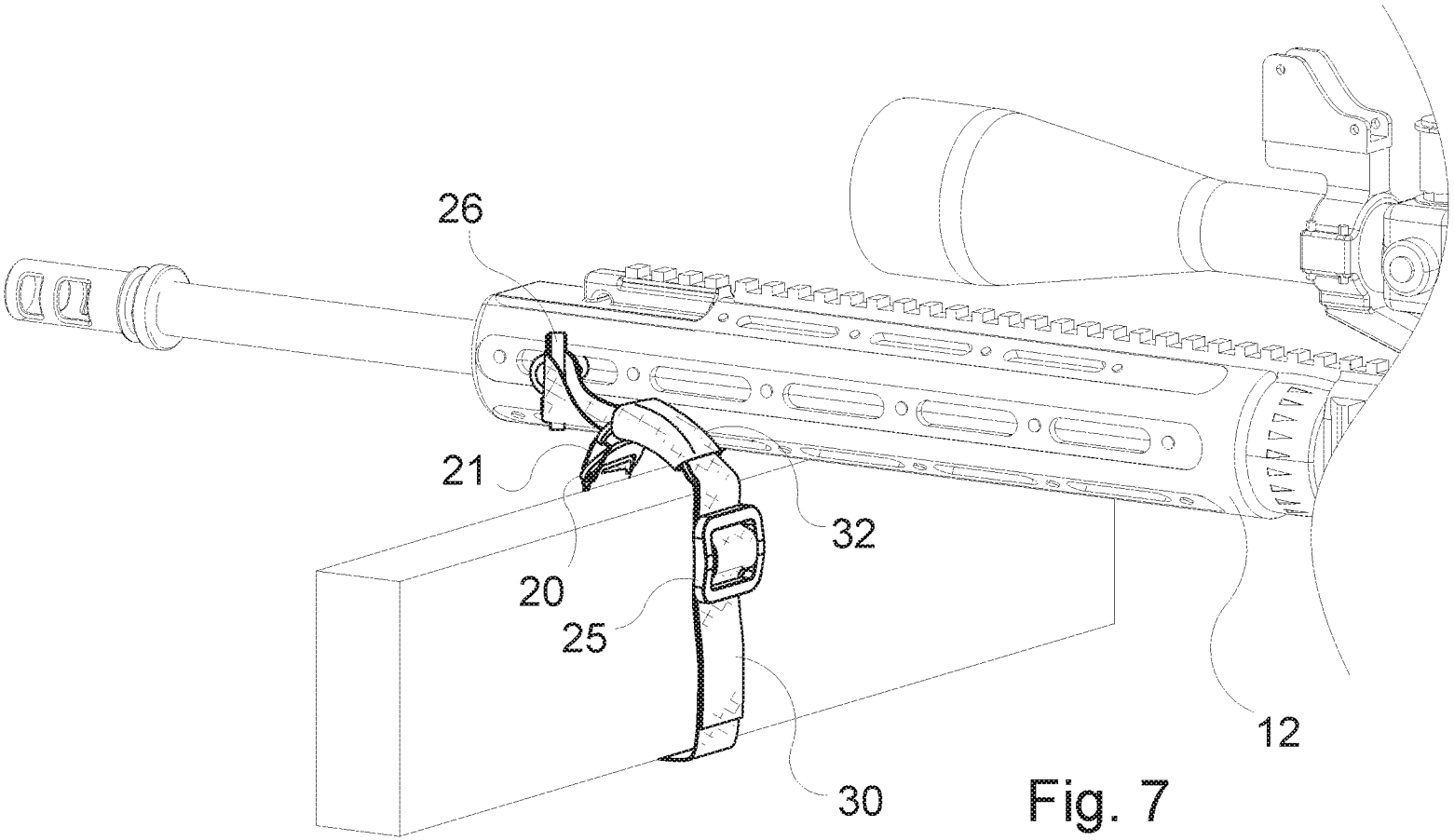

FIG. 7 shows the shooting adapter in use without a carry sling. Having the ability to hook onto itself lets it serve as a shooting aid when wrapped around objects in the field.

A listing of reference numerals corresponding to the drawings filed with the present application, is provided below.

10: Shooting Adapter Assembly
11: Shooter
12: Firearm
14: Carry sling
15: Mounting post
16: Fireman midpoint
20: Proprietary hook
21: Steel gate
25: Triglide
26: Quick detach swivel
30: Nylon Webbing
31: Sewn webbing
32: Elastic keeper
40: Proprietary hook alternate embodiment

I claim:

1. A rifle sling comprising:

a first portion having a forward end including a first attachment facility configured for attachment to a forward portion of a rifle;

a second portion having a rear end including a second attachment facility configured for attachment to a rear portion of a rifle;

a connector configured to removable connect the first and second portion;

the connector including three parallel bars collectively defining two elongated slots;

one of the slots having a lateral opening at a slots end, the opening configured to removably retain a strap and to permit removal and insertion of an intermediate portion of the strap.

* * * * *